United States Patent [19]

Rabus et al.

[11] 4,173,962

[45] Nov. 13, 1979

[54] IGNITION SYSTEM WITH ESSENTIALLY CONSTANT IGNITION COIL ENERGY SUPPLY

[75] Inventors: Friedrich Rabus, Schwieberdingen; Günter Gräther, Pinache, both of Fed. Rep. of Germany

[73] Assignee: Robert Bosch GmbH, Stuttgart, Fed. Rep. of Germany

[21] Appl. No.: 871,345

[22] Filed: Jan. 23, 1978

[30] Foreign Application Priority Data

Jan. 28, 1977 [DE] Fed. Rep. of Germany ..... 2703431

[51] Int. Cl.[2] ..... F02P 1/00; F02P 5/04

[52] U.S. Cl. ..... 123/148 E; 123/117 R

[58] Field of Search ..... 123/148 E, 117 R, 117 D

[56] References Cited

U.S. PATENT DOCUMENTS

| | | | |
|---|---|---|---|
| 3,559,629 | 2/1971 | Sauvignet | 123/148 E |
| 3,890,944 | 6/1975 | Werner | 123/117 R |
| 3,937,193 | 2/1976 | Kim | 123/117 R |
| 3,938,490 | 2/1976 | Snyder et al. | 123/148 E |
| 4,043,302 | 8/1977 | Sessions | 123/148 E |
| 4,057,740 | 11/1977 | Arguello | 123/148 E |
| 4,117,819 | 10/1978 | Jarrett et al. | 123/148 E |

*Primary Examiner*—Ronald B. Cox

*Attorney, Agent, or Firm*—Frishauf, Holtz, Goodman & Woodward

[57] ABSTRACT

To provide sufficient current flow to the ignition coil in an ignition system of an automotive-type internal combustion engine under high-speed conditions, without excessive current flow under other speed conditions, a memory is provided which is loaded in the time interval between successive signals in advance of the ignition instant, separated by a time which decreases as the speed of the engine increases, the memory accumulating a stored value which is representative of the time duration. The memory is cleared or unloaded under controlled conditions in the interval between the occurrence of the second signal and the next subsequent first signal at controlled rates, one rate occurring during a timing interval established by a timing circuit, the timing interval of which depends on an operating parameter of the ignition system, for example supply voltage, and at a second rate after the timing interval, the unloaded or cleared time of the memory controlling current flow through the ignition coil for the next subsequent ignition pulse or ignition cycle to thereby maintain a minimum time of current flow through the ignition coil without extending the current flow if the time interval between successive signals becomes longer as a consequence of intermediate or low-speed operation of the engine.

12 Claims, 3 Drawing Figures

IGNITION SYSTEM WITH ESSENTIALLY CONSTANT IGNITION COIL ENERGY SUPPLY

Cross reference to related applications, assigned to the assignee of the present application:

U.S. Ser. No. 865,577, filed 12/29/77, FRESOW et al;

U.S. Ser. No. 865,578, filed 12/29/77, SOHNER et al;

U.S. Ser. No. 798,331 now U.S. Pat. No. 4,138,977, filed May 19, 1977, GRATHER et al;

U.S. Ser. No. 799,247 now U.S. Pat. No. 4,162,665, filed May 23, 1977, GRATHER et al.

The present invention relates to an ignition system for internal combustion, and more particularly to an ignition system in which a semiconductor switch controls current flow through the primary of an ignition coil for a period of time just sufficient to store electromagnetic energy in the coil without prolonged current flow therethrough after the energy has been stored.

BACKGROUND AND PRIOR ART

Various types of semiconductor controlled ignition systems have been proposed; in one such system, a first signal is generated at a predetermined angular position of a piston in the internal combustion engine, and thereafter a second signal, the second signal causing generation of an ignition event, that is, opening of the semiconductor switch in the primary circuit to induce a high-voltage pulse in the secondary, causing arc-over at a spark plug. The signals are preferably generated by transducer systems which may be magnetic-conductive, magnetic with other types of pick-ups, for example a Hall generator, optical controls, or the like. Such ignition systems have been described, for example, in German Disclosure Document DT-OS No. 2,448,675, and in U.S. Pat. No. 3,587,551. In these systems, the saturation current which causes losses is reduced, so that the losses in the primary ignition circuit of the ignition system likewise will be reduced. An electronic switch is provided, the open or blocked time thereof being so selected that, when the switch closes, there is still sufficient time for current to rise as it flows into the inductance of the ignition coil. If the engine rotates slowly, then the current will remain in the saturation region for an excessively long time, resulting in substantial power losses in the coil itself, undesired heating thereof, and undesired heating of electronic components to which the system is connected.

THE INVENTION

It is an object to provide an ignition system in which the current flow through the ignition coil will be the minimum current—with some safety factor—which will store sufficient electromagnetic energy in the coil to provide an efficient spark at all speed ranges of the engine without, however, causing current flow for an excessive period of time, that is, after the electromagnetic energy has been stored.

Briefly, two sequential signals are generated, one signal at a predetermined angular position of a piston in advance of top dead center (TDC) position of the piston, and another signal subsequent thereto, to generate an ignition event, that is, to control the time of occurrence of the spark with respect to the angular position of the piston. A memory is provided, which may be a capacitor or a counter, depending upon whether the system uses analog or digital technology. The memory is continuously charged during the time interval between the first and the second pulse to accumulate a stored value therein which is representative of the time duration, and hence of the speed of the engine. Thereafter, the memory is discharged or cleared or unloaded at controlled rates, one rate being effective during a timing interval, the time duration of which depends on an operating parameter of the system, for example supply voltage; and at another, and preferably lesser, rate subsequent thereto. When the memory has discharged to a predetermined value, for example to zero, a pulse is generated which controls a switch, typically a transistor, in series with the primary of the induction coil to become conductive, thus passing through the induction coil. This current will rise gradually and reach saturation, and then shortly thereafter, is interrupted, thereby causing an ignition event, that is, induction of a high-voltage pulse in the secondary of the ignition coil which causes flash-over of the spark at a spark plug.

The system ensures that the current rise through the primary of the ignition coil will always be up to the desired design value. After the current has reached the full design value, a short safety period or safety time reserve is provided so that the current will reliably rise to the design value even if the speed information is incorrect, due to the delay occurring in the memory stage. Such incorrect information may arise during rapid acceleration of the engine. The period of reserve charge time, after the current has reached the desired or command value, can be so arranged that the final current flow through the coil is at command value, and yet not for an excessive period of time over the entire speed range as well as under acceleration conditions. This permits reduction of the overall current flow through the coil, and hence through the controlled switch, typically a transistor. Yet, the commanded or design value of current is always reached.

In accordance with a feature of the invention, a current limiting stage is connected to the primary of the ignition coil. The discharge rate of the controlled discharge or unloading or clearing arrangement for the memory is so arranged that the discharge is slightly greater than the charge rate, the increase being small, however, preferably less than about 5%. By limiting the current during the reserve charge time, it is possible to reduce additional losses, thus protecting the main switch, typically a power switching transistor in series with the ignition coil. Yet, a constant and design value of ignition energy has always been reached.

The system can be constructed in accordance with both analog as well as digital technology. Digital technology has particular advantages; the memory can be constructed as a digital counter, and the charge and discharge sources or stages can be constructed as frequency generators. The reserve charge time can be minimized and exactly set when using a digital system.

Drawings, illustrating two examples:

Figure 1:
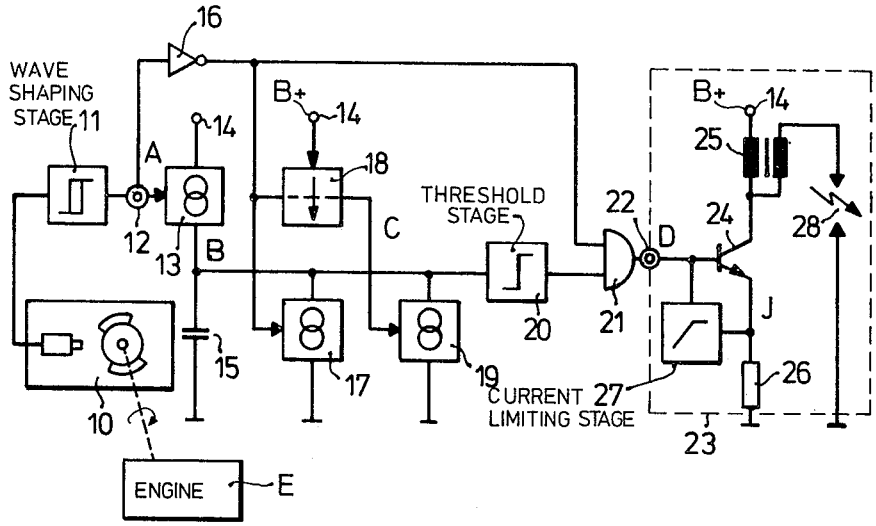
FIG. 1 is a schematic diagram of the ignition system, in analog form.

The crankshaft of an internal combustion engine, shown generally at E, is connected to a transducer having, for example, a rotating disk with magnetic discontinuities thereon in magnetically coupled relationship to a pick-up. The output from the transducer 10 is connected to a wave-shaping stage 11, for example in the form of a Schmitt trigger. The transducer 10 is illustrated as an inductive-magnetic transducer, but can be of any suitable type, for example a breaker-type contact, a Hall generator, an optical transducer, or the like. It is only necessary that the transducer provide a sequence of signals having a predetermined ON/OFF ratio or duty ratio (for example ON/ON +OFF ratio). The output from transducer 10 can also be derived from single sequential signals which trigger a bistable stage, forming the wave-shaping stage 11. The transducer 10 can use a mechanical or electrical system to change the relationship of occurrence of the signals in dependence on speed or other operating or operation parameters of the engine or its environment. Ignition timing, that is, change, typically advance of the ignition angle as controlled by such systems, can be connected between the transducer 10, the wave-shaping stage 11, or subsequent to the wave-shaping stage 11.

The output of the wave-shaping stage 11 is connected to a junction 12. Junction 12 is connected to the control input terminal of a charge current source 13. Charge current source 13 is connected to the positive terminal 14 of a supply voltage source (not shown). The charge current source 13 provides charge current to a memory or storage device shown as capacitor 15. The other terminal of capacitor 15 is connected to ground or chassis or reference potential, generally shown at R. The junction 12 is connected through an inverter 16 to a control input of a discharge current control state 17. Stage 17 is connected in parallel to capacitor 15. The output of the inverter 16 is additionally connected to a timing circuit 18. Timing circuit 18, preferably, is a monostable multivibrator providing a timing interval when triggered. It is connected to a second discharge stage 19, likewise connected in parallel to capacitor 15. The terminal 14 is connected to a control input of timing circuit 18 so that the timing interval of the timing circuit 18 will be controlled by the level of the supply voltage, schematically shown as B+.

The junction formed by the ungrounded terminal of capacitor 15, current source 13, discharge current stages 17, 18 is connected to a threshold switch 20, the output of which is connected to one input of an AND-gate 21, the other input of which is fed by the output from the inverter 16. The output of AND-gate 21 is connected to a terminal 22, forming the input terminal of an ignition stage 23. Ignition stage 23 may be of any well-known type; in the example shown, terminal 22 is connected to the control input of a switch 24, preferably a controlled semiconductor switch, and most suitably a transistor. The B+ terminal 14 is additionally connected to the primary of an ignition coil 25, which is connected to the collector-emitter path of the transistor 24 and through a sensing resistor 26 to ground or reference potential. Terminal 22 is additionally connected to a current limiting stage 27 which is controlled by the voltage drop across sensing resistor 26. The secondary of ignition coil 25 is connected, as usual, to a spark gap 28 which typically is a spark plug. For multi-cylinder engines, a distributor (not shown) is interposed between the secondary of coil 25 and the respective spark plugs 28. The current measuring system 26 and the current limiting stage are described in the aforementioned German disclosure document and U.S. patent.

Figure 2:
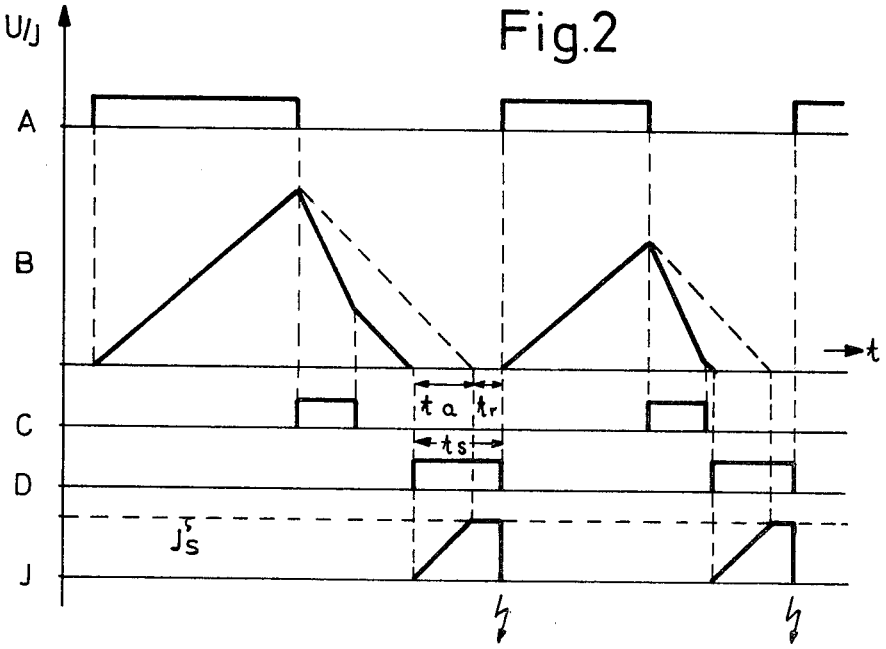
FIG. 2 is a series of graphs illustrating the operation.

Operation, with reference to FIG. 2: The series of graphs of FIG. 2 have been lettered, and the terminals or lines where signals of the graphs of FIG. 2 appear have been similarly lettered in FIGS. 1 and 3. For purposes of explanation, the notation customary in digital technology will be used, in which a 1-signal refers to a voltage level in the order of the voltage of the supply source 14, while a 0-signal corresponds to a voltage of approximately reference voltage level.

A sequence of signals are generated by a transducer 10. The signal train generated by the transducer 10 will depend on the speed of the output shaft of the engine E and will have a certain duty cycle. The signal train generated by the transducer 10 is transformed into square wave signals A. The signals A cause connection of the charge current source 13. Consequently, capacitor 15 will charge. The capacitor voltage is illustrated in the graph B of FIG. 2. The discharge stages 17, 19 are blocked during the charge portion of the cycle. At the termination of the signal A, and forming a first signal, the charge current source 13 is disconnected. The inverter 16 will provide a signal which has two effects: (1) The discharge stage 17 is enabled; and (2) the timing interval of timing circuit 18 is started. The output of the timing circuit 18 provides a signal C during the timing interval. This signal controls the second discharge stage 19 to be conductive or effective. Thus, during the duration of the signal C, the capacitor 15 can discharge through both discharge stages 17, 19. The second discharge stage 19 is disconnected upon termination of the timing interval, that is, when the timing stage 18 reverts back to open or disconnected state. From that time on, discharge can occur only at a slower rate, as controlled by the discharge stage 17 only. Consequently, the discharge characteristic curve will have a lesser slope. When the capacitor 15 is discharged, its charge state will drop below a certain predetermined threshold. This threshold may be zero, or very close to it. The threshold sensing circuit 20 senses when the capacitor 15 is discharged, or essentially discharged, and will provide a 1-signal at its output. Since the inverter 16 is also providing a 1-signal, AND-gate 21 is enabled and the output thereof will have a signal D thereon. AND-gate 21 has become conductive since both its inputs will have 1-signals, so that the output will have the signal D which controls the transistor 24 to become conductive. A rising current J will flow in the primary of the ignition coil 25. Let it be assumed that the supply voltage B+ is essentially constant. The current J will reach a predetermined design value Js after a current flow rise time. When the current has risen to the value Is, the current limiting stage 27 senses the current flow through the resistor 26 and will hold the current to be constant at that level. When a new signal A occurs, that is, at a rising flank of the signal A which may form a second control signal, transistor 24 will block, causing an inductive voltage pulse in the secondary of coil 25 and arc-over at the spark gap 28, thus generating an ignition event.

Supply voltage variations can be balanced by varying the timing interval of the timing circuit 18, that is, by connecting the timing control terminal of timing circuit 18 to the voltage source 14, so that the timing interval will be dependent on the voltage level. The connection is so made that, as the supply voltage drops, the timing interval increases.

The threshold stage 20 is not strictly necessary; the gate 21 can be so designed that it responds to a predetermined threshold level and, for example, has an inverting output so that, when the voltage on capacitor 15 has dropped to a zero level, the gate 21 will open. In another simplification, the timing interval of the timing circuit 18 can be maintained essentially constant, and independent of the level of supply voltage connected to terminal 14; the current limiting stage 27 as well as the current sensing resistor 26 can also be omitted in a simplified embodiment.

The closed or ON-time of the switch formed by transistor 24 is a composite of the time ta until the nominal current value Js is reached, and a reserve or holding time tr during which, if a current limiting stage 27 is provided, the current is held essentially constant. The charge or storage time to store magnetic energy in the coil 25 ta is approximately constant and, in an example, is about 300 microseconds. This time period should not vary substantially throughout the entire design speed range of the engine E. If the engine is under conditions of acceleration, then the next subsequent signal A will occur at an earlier time period. The reserve time tr is used to permit the rise time ta to be undiminished even under the highest possible acceleration of the engine. The reserve time tr can be mathematically derived as follows:

$$tr=(\dot{n})_o/(k^2 \cdot n_o^3) \quad (1)$$

in which $n_o$ is the instantaneous engine speed; $(\dot{n})_o$ is the essentially constant engine acceleration; k is the number of cylinders. The safety time tr is speed dependent. The percent deviation between signals A, from signal to signal, is given by:

$$\frac{tr}{1/kn_o} = \frac{(\dot{n})_o}{kn_o^2} \quad (2)$$

wherein, in an example, $(\dot{n})_o$=2000 rpm/sec; k=6; $n_o$=1000 rpm, then a value of tr=200 microseconds is obtained, or a percent deviation of about 2%. The percent deviation from marker to marker rapidly becomes less due to the factor $1/n_o^2$ as the speed increases. Thus, at a constant acceleration, a constant value of tr=constant ≈200 microseconds can be used as an approximately universally suitable safety period for the ON time of switch 24—excluding starting conditions and, for purposes of this example, neglecting consequent delay in ignition timing. At high speeds, for example at 6000 rpm, a safety time period of 200 microseconds would result in an ON ratio of 12%, corresponding to quite substantial power loss. Rather than using a fixed period of time, the system in accordance with the present invention considers the largest suitable percentage for the percent variation between successive marker signals A, and considers this percentage independent of the speed and as a constant value. An average value can be calculated and results in about 2%. Constructing a circuit based on this consideration has the advantage that the complicated function $1/n_o^2$ need not be computed. A fixed approximation suffices.

Figure 3:
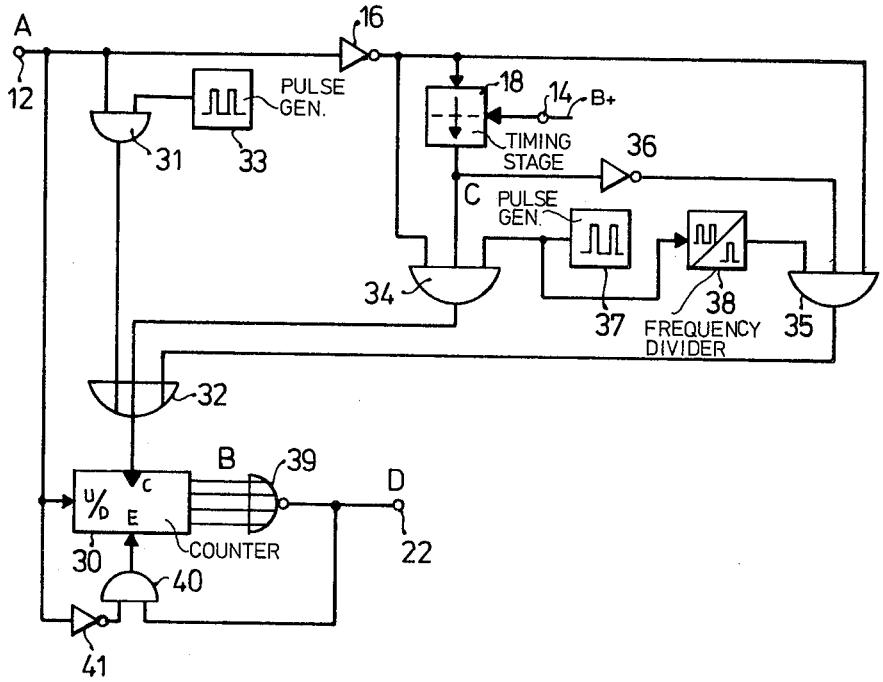
FIG. 3 is a schematic diagram of the system in digital technology.

Embodiment of FIG. 3: The essential operation is similar to that shown in connection with FIG. 1, and similar signals and terminals have been similarly labelled or lettered. The circuit portion between terminals 12 and 22 has been replaced by a digital system. Junction 12 is connected to the count direction input, forming an UP/DOWN (UD) input of a digital counter 30. Junction 12 is further connected through an AND-gate 31 to one input of an OR-gate 32, the output of which is connected to the clock or counting input C of counter 30. The AND-gate 31 is additionally connected to a frequency or pulse generator 33. Junction 12 is further connected through inverter 16 with one input, each, of two AND-gates 34, 35, the outputs of which are connected to other inputs of the OR-gate 32. The output of inverter 16 is further connected to the input of timing circuit 18, the output of which is connected to a further input of AND-gate 34. The output of timing circuit 18 is additionally connected through a second inverter 36 to a further input of AND-gate 35. A second pulse generator 37 is connected to a further input of AND-gate 34 and through a frequency divider 38 to a further input of the AND-gate 35. The count outputs of the counter 30 are connected to a zero count state recognition circuit 39, formed by a NOR-gate, the output of which is connected to the output terminal or junction 22. The terminal 22 is connected back through an AND-gate 40 with a blocking input E of the counter 30. A third inverter 41 is connected to the second input of AND-gate 40, and supplied from junction 12.

Operation, with reference to FIG. 2: The graph B of FIG. 2 now does not represent the charge state of a capacitor but, rather, the count state of counter 30. During the signal A, the two AND-gates 34, 35 are blocked by the inverter 16. The AND-gate 31 is open and passes pulses from pulse generator 33 through OR-gate 32 to the count input C of the counter 30. The signal at junction 12, likewise, has controlled the U/D input of the counter so that the counter will count up. During the signal A, therefore, the counter 30 will accumulate a count state counting the pulses at the rate of the pulse generator 33. Upon termination of the signal A, AND-gate 31 will block and the gates 34, 35 will become conductive. Simultaneously, the U/D terminal of the counter is switched over so that the counter will now count down. Upon a 1-signal at the output of inverter 16, timing circuit 18 will start a timing interval—as in FIG. 1—and the C signal will appear. AND-gate 35 will continue to remain blocked through inverter 36. AND-gate 34 will be open, however, and permit the frequency of the second pulse generator 37 to pass through AND-gate 34 and to the count input terminal C of counter 30 which will now count down at the rate of the second pulse generator 37. When the timing interval of timing circuit 18 has terminated, the output thereof changes from a 1-signal to a 0-signal, AND-gate 34 blocks, and AND-gate 35 opens. Further counting down in the counter 30 is now controlled at a rate which is modified by the divider 38. The pulses from second pulse generator 37, as divided in frequency divider 38, can now be passed through the AND-gate 35 and OR-gate 32 to be applied to the count terminal C of counter 30. Down-counting will now occur at a slower rate. When the lowest count state has been reached, for example a count state of 0, then the zero recognition stage 38 will provide an output signal which, for one, is applied to the output terminal 22 to cause the electronic switch 24 in the primary of the ignition coil 25 to be conductive; and for another, to be transferred through AND-gate 40 to block counter 40 over a blocking input E to prevent further counting thereof. Blocking of counting of counter 30 is terminated only when a new signal A appears, which, transmitted over inverter 41, disables application of any signal to the input E of the counter 30.

The time relationships above discussed, and particularly in connection with the mathematical analysis, are equally valid for the digital system. Thus, assuming a duty ratio of the signal train shown in graph A of unity, the output frequency of the frequency divider 38 should be less by about 2% than the frequency of the pulse generator 33. This relationship can vary in accordance with the mathematical relationships discussed above in dependence on the respective parameters of the engine with which the system is to be used. Assuming other duty ratios of the signal train A, it is necessary to shift the frequency relationship correspondingly. If the timing circuit 14 should directly control the rise time ta, then the frequency of the second frequency generator 37 must be twice that of the output frequency of the frequency divider 38. Consequently, the frequency divider 38 must divide by two, that is, the frequency divider 38 must operate in a proportion of 2:1. The relationship of the timing interval of the timing stage 18 with respect to the current rise time ta in the ignition coil 25 will change correspondingly if other division ratios are selected. The overall current flow period ts will be the composite of the current rise time ta plus the safety period tr, and terminating at the ignition instant.

The system of the present invention can be used especially in extended spark ignition systems, that is, in ignition systems in which a plurality of ignition sparks are generated for each ignition event, the first arc-over of the spark gap or spark plug occurring at the ignition instant, and subsidiary discharges occurring thereafter. Reference is made to cross-referenced applications assigned to the assignee of the present invention, U.S. Ser. Nos. 798,331 and 799,247, filed May 19 and May 23, 1977, GRATHER, et al now Pat. Nos. 4,138,977 and 4,162,665 for systems of this kind.

Various changes and modifications may be made, and features described in connection with any one of the embodiments may be used with any of the others, within the scope of the inventive concept.

We claim:

1. Ignition system for an internal combustion engine (E) having an ignition coil (25);

a controlled main switch (24) connected in series with the primary (24) of the ignition coil and controlling current flow therethrough;

means (12) coupled to the engine providing a first signal occurring at the time in advance of the ignition instant, and a second signal subsequent to the first signal and commanding interruption of current flow through the coil to cause an ignition event;

and means controlling the duration of current flow through the ignition coil in advance of the ignition event to be essentially independent of the speed of the engine, and hence of the repetition rate of said first and second signals, comprising, in accordance with the invention, a memory (15, 30);

controlled memory loading means (13; 31, 33) loading the memory in the time interval between said second signal and a subsequent first signal, and accumulating a stored value therein representative of said time duration;

controlled memory clearing means (17, 30) unloading the memory in the time interval between the occurrence of the first signal and the occurrence of the next subsequent second signal at variable and controlled rates;

a timing means (18) establishing a timing interval connected to said controlled memory clearing means and controlling the unloading rate during the timing interval thereof to differ from the unloading rate subsequent to said timing interval;

and means (20, 21; 39) connected to and controlled by said memory (15, 30) and responsive to a predetermined storage or loading state of the memory controlling said main switch (24) to close the circuit through the primary of the ignition coil (25) to store magnetic energy therein in the interval after the memory has reached said predetermined storage state and before the occurrence of the second signal commanding interruption of the current flow through the coil to cause said ignition event.

2. Ignition system according to claim 1, wherein the memory clearing or unloading means includes two unloading stages (17, 19; 37, 38) connected to said memory, one of said unloading stages (19; 37) being controlled by said timing means (18) and unloading said memory at a rate which is higher than the unloading rate of the other of said clearing or unloading means (17; 38).

3. Ignition system according to claim 2, wherein the ratio of the clearing or unloading rate of the second unloading stage (17, 38) to the loading rate of the controlled memory loading means (13; 31, 33) is greater than the duty ratio of the respective cycles occurring between the first and second signal, and then between the second and subsequent first signal of a signal train having, alternately, first and second signals.

4. Ignition systems according to claim 3, wherein the clearing or unloading rate of the second unloading stage (17, 38) is higher than the loading rate by the memory loading means by a percent factor defined by $(\dot{n})_o/(-k \cdot n_o^2)$, wherein $(\dot{n})_o$ represents acceleration; k the number of cylinders of the engine (E); $n_o$ the speed of the engine (E);

and wherein said percentage factor forms the largest value of speed and acceleration for the respective engine.

5. Ignition system according to claim 1, further including a current limiting circuit (26, 27) connected to the primary coil of the ignition coil (25).

6. Ignition system according to claim 3, wherein said discharge stages comprise two parallel connected discharge circuits (17, 19).

7. Ignition system according to claim 1, wherein the memory comprises a capacitor;

said memory loading means comprises a capacitor charge source (13);

and said memory clearing means comprises two parallel connected capacitor discharge circuits (17, 19), one of said discharge circuits (19) being connected to and controlled by said timing means (18) to provide a discharge path for said capacitor in addition to the discharge path provided by the circuit of the other of said discharge stages (17).

8. Ignition system according to claim 1, wherein the memory comprises a digital counter (30);

said memory loading means, and said controlled memory clearing means, respectively, comprises pulse generator means (33; 37, 38) providing count pulses to said digital counter (30) to enter digital values representative of the time duration upon loading of said memory, and to remove from the then resulting count state of said counter digital values during unloading or clearing of said digital memory.

9. Ignition system according to claim 8, wherein said pulse generator means, and forming at least part of the memory clearing means, comprises pulse frequency generator means (37, 38) having, respectively, a higher frequency and a lower frequency, and a logic circuit (34–39) respectively connecting the higher frequency, during said time interval, and under control of said timing means (18) and thereafter the lower frequency to the counter (30).

10. Ignition system according to claim 9, wherein said pulse generator means includes a single pulse generator (37) and a frequency divider to generate said frequency having the lower frequency rate.

11. Ignition system according to claim 1, including means (14) controlling the timing interval of said timing circuit (18) as a function of an operating parameter of at least one of: the engine; the ignition system.

12. Ignition system according to claim 1, further including means (14) connecting the timing means (18) to the source of supply voltage (B+) for said system, to control the timing interval of said timing means as a function of supply voltage of said system.

* * * * *